United States Patent [19]

Anderson et al.

[11] 3,969,220

[45] July 13, 1976

[54] AERATING TAR SANDS-WATER MIXTURE PRIOR TO SETTLING IN A GRAVITY SETTLING ZONE

[75] Inventors: Joseph C. Anderson, Fort McMurray; H. James Davitt, Edmonton, both of Canada

[73] Assignees: Great Canadian Oil Sands Limited, Toronto, Canada; Sun Oil Company of Pennsylvania, Philadelphia, Pa.

[22] Filed: Sept. 16, 1974

[21] Appl. No.: 506,371

[52] U.S. Cl. ..... 208/11 LE
[51] Int. Cl.[2] ..... C10G 1/04
[58] Field of Search ..... 208/11

[56] References Cited

UNITED STATES PATENTS

| | | | |
|---|---|---|---|
| 3,401,110 | 9/1968 | Floyd et al. | 208/11 |
| 3,487,003 | 12/1969 | Baillie et al. | 208/11 |
| 3,509,037 | 4/1970 | Tse | 208/11 |
| 3,530,042 | 9/1970 | Graybill et al. | 208/11 |
| 3,558,469 | 1/1971 | White et al. | 208/11 |
| 3,607,720 | 9/1971 | Paulson | 208/11 |

*Primary Examiner*—Delbert E. Gantz
*Assistant Examiner*—James W. Hellwege
*Attorney, Agent, or Firm*—J. Edward Hess; Donald R. Johnson; Richard P. Maloney

[57] ABSTRACT

In a hot water process for extracting bitumen from tar sands comprising forming a mixture of tar sands and water, settling the mixture in a primary extraction zone to form an upper bitumen froth layer, a middlings layer, and a sand tailings layer, passing a part of the middlings layer to an air scavenger zone to recover additional bitumen therefrom, the improvement which comprises aerating the mixture of tar sands and water before separating bitumen froth from the mixture in a gravity settling zone. This aeration can be accomplished by adding an aerated recycle middlings stream to the tar sands water-mixture prior to the settling step.

1 Claim, 1 Drawing Figure

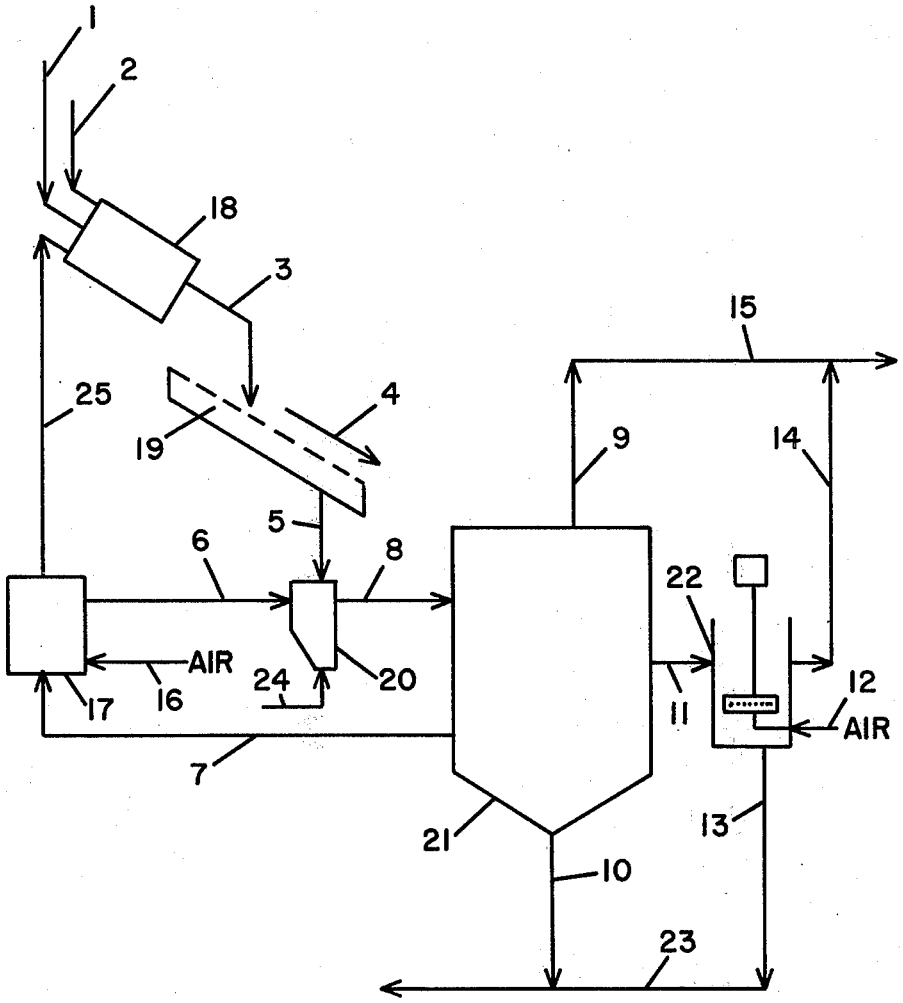
1
2
18
3
15
25
4
19
9
14
5
6
8
22
AIR
24
20
12
17
16
11
AIR
7
21
13
10
23

AERATING TAR SANDS-WATER MIXTURE PRIOR TO SETTLING IN A GRAVITY SETTLING ZONE

BACKGROUND OF THE INVENTION

Tar sands which are also known as oil sands and bituminous sands are siliceous materials which are impregnated with a heavy petroleum. The largest and most important deposits of the sands are the Athabasca sands, found in northern Alberta, Canada. These sands underlay more than 13,000 square miles at a depth of 0 to 2000 feet. Total recoverable reserves after extraction and processing are estimated at more than 300 billion barrels—just equal to the world-wide reserves of conventional oil, sixty percent of which is in the Middle East. By way of contrast, the American Petroleum Institute estimated total United States oil reserves at the end of 1965 at 39.4 billion barrels.

The tar sands are primarily silica, having closely associated therewith an oil film which varies from about 5 percent to 21 percent by weight, with a typical content of 13 weight percent of the sand. The oil is quite viscous—6° to 8° API gravity—and contains typically 4.5 percent sulfur and 38 percent aromatics.

The sands contain, in addition to the oil and sand components, clay and silt in quantities of from 1 to 50 weight percent, more usually 10 to 30 percent. The sands also contain a small amount of water, in quantities of 1 to 10 percent by weight, in the form of a capsule around the sand grains.

Several basic extraction methods have been known for many years for the separation of oil from the sands. In the so called "cold water" method, the separation is accomplished by mixing the sands with a solvent capable of dissolving the bitumen constituent. The mixture is then introduced into a large volume of water, water with a surface agent added, or a solution of a neutral salt in water, which salt is capable of acting as an electrolyte. The combined mass is then subjected to a pressure or gravity separation.

In the hot water method, as disclosed in Canadian Pat. No. 841,581 issued May 12, 1970 to Floyd et al., the bituminous sands are jetted with steam and mulled with a minor amount of hot water at temperatures of 170° to 190°F., and the resulting pulp is then dropped into a turbulent stream of circulating hot water and carried to a separation cell maintained at a temperature of about 185°F. In the separation cell, sand settles to the bottom as tailings and oil rises to the top in the form of a froth. An aqueous middlings layer comprising clay and silt and about 1 to 5 weight percent bitumen based on the weight of the middlings is formed between these layers. This basic process may be combined with a scavenger step for further treatment of the middlings layer obtained from the primary separation step to recover an additional amount of oil therefrom.

The middlings layer withdrawn from the hot water separation cell in a hot water extraction process contains most of the silt and clay as well as some bitumen. In the hot water extraction process disclosed by Floyd et al. above, a stream of middlings is withdrawn from the primary extraction zone and recycled to the conditioning vessel of the hot water process. Also, a second stream of the middlings is transferred from the primary extraction zone to an air scavenger zone wherein air is bubbled into the material in the scavenger zone to cause flotation of additional bitumen from the middlings material. This bitumen is then recovered as a froth and combined with the bitumen froth recovered from the primary extraction zone. The depleted middlings stream which now contains less bitumen, usually 0.5 to 2.0 weight percent, is normally thereafter discarded into a retention pond or in some circumstances combined with the sand tailings layer which is normally removed from the primary extraction zone and subsequently discarded.

One of the problems encountered in the above described hot water process is the inefficiency of recovery which sometimes occurs in the primary extraction zone. When the viscosity of the middlings increases, poor flotation is realized with resulting lower bitumen recovery rates.

The present invention provides an improvement to the above-disclosed hot water extraction process which aids in improving recovery of bitumen from tar sands in a primary extraction zone of a hot water process.

For purposes of definition, in the present disclosure the term "bitumen-rich middlings" defines a middlings material recovered from the gravity settling separation zone of a hot water process for extracting bitumen from tar sands which middlings material is characterized as containing water, silt, clay, and about 1.0 to 5.0 weight percent bitumen. In turn, the term "bitumen-lean middlings" or "bitumen-depleted middlings" defines bitumen-rich middlings which have been treated in an air scavenger zone to extract bitumen and, therefore, result in middling containing 0.5 to 2.0 weight percent bitumen. In all events, bitumen-lean middlings always contain less bitumen than the bitumen-rich middlings material whence they came.

DESCRIPTION OF THE INVENTION

The present invention is an improved hot water method by which air is added to the tar sands-water mixture to improve recovery of bitumen in a primary extraction zone. Specifically, the present invention comprises aerating the tar sands-water mixture in the dilution sump wherein the mixture is diluted with water prior to separating bitumen from the tar sands in the primary extraction zone of a hot water process for recovering bitumen from tar sands. Also, the present invention includes a method utilizing aerated bitumen-rich middlings to improve recovery of bitumen in a primary extraction zone. More specifically, a bitumen-rich middlings stream recovered from a primary extraction settling zone is aerated and thereafter utilized to dilute the tar sands-water mixture prior to settling the tar sands-water mixture in the primary extraction zone of a hot water process for recovering bitumen from tar sands. The aerated bitumen-rich middlings material contains entrained air bubbles. When added to a tar sands-water mixture prior to separation in a hot water extraction cell, the air bubbles aid in flotation of bitumen in the extraction cell thereby improving recovery of bitumen therefrom.

To more clearly illustrate one mode of the method of the present invention, the following drawing is provided. Referring to the drawing, bituminous tar sands are fed into a hot water extraction system through line 1 where they first pass into conditioning zone 18. Water and steam are introduced from line 2 into the conditioning zone and are mixed with the sands. Also, aerated bitumen-rich middlings material recovered from aeration zone 17 can be introduced into conditioning zone 18 via line 25 as a part of the water to be added to the tar sands. Total water so introduced is a minor amount based on the weight of the tar sands and generally is in the range of 10 to 45 percent by weight of the mixture. Enough steam is introduced to raise the temperature in the conditioning drum to within the range of 130° to 210°F. and preferably above 170°F. and most preferably about 185°F.

An alkaline reagent can also be added to the conditioning zone using the amount of about 0.1 to 3.0 pounds per ton of tar sand. The amount of such alkaline reagent preferably is regulated to maintain the pH of the middlings layer in the separation zone 21 within the range of 7.5 to 9.0 with best results being obtained at a pH value in the range of 8.0 to 8.5. The quantity of alkaline reagent that needs to be added to maintain the pH in the desired range can vary from time to time as the composition of the tar sands obtained from the mine site varies. Alkaline reagents suitable for use include caustic soda, sodium carbonate, or sodium silicate, although any of the other alkaline-containing reagents known in the art for this application can be used if desired.

The mixture from conditioning zone 18 can be transferred via line 3 to screen 19 wherein oversize matter such as rock and tar sands or clay lumps are removed as indicated at 4. The pulp then passes as indicated via line 5 into sump 20 wherein it is diluted with additional water from line 6 which in one mode of practice of the present invention is recycled aerated bitumen-rich middlings from aeration zone 17.

The addition of the aerated bitumen-rich middlings to the pulp in sump 20 dilutes the pulp to a pumpable viscosity as well as adds entrained air bubbles to the mixture. In another mode of the present invention, compressed air can be introduced into sump 20 via line 24 to aerate the tar sands-water mixture so that when transferred to settler 21 the mixture contains entrained air. The diluted mixture can be easily transferred into separation zone 21 via line 8 as indicated. Additional water or aerated bitumen-rich middlings can also be added to screen 19 to wash the pulp through the screen and act as the diluent for the pulp. In normal practice, the total amount of water added to the tar sand pulp as liquid water and steam prior to the separation step should be in the range of 0.2 to 3.0 pounds of water per pound of tar sands being processed. The water requirements for the separation zone, of course, are contingent upon the quantity of silt and clay which the tar sands contain as compared to the bitumen content of the tar sands. These conditions are amply described in the prior art.

In separation zone 21, the aerated mixture is permitted to settle. When settled, the contents of the separation zone, aided by the added entrained air bubbles, separate into an upper bitumen froth layer, a middlings layer containing silt, clay, and bitumen normally in the range of 1 to 5 weight percent of the middlings, and a sand tailings layer. The bitumen froth is recovered from separation zone 21 via line 9. The tailings layer of extraction zone 21 containing sand and some bitumen-rich middlings material is withdrawn via line 10 and discarded into line 23 which normally empties into a retention pond. A middlings drag stream is withdrawn from separation zone 21 and transferred via line 11 into air scavenger zone 22. Air is added to scavenger zone 22 as indicated in the drawing. Additional bitumen froth is recovered from zone 22 and is transferred via line 14 into line 15 where it is combined with the primary froth from line 9 from extraction zone 21 and can be further processed into suitable petroleum product.

A second bitumen-rich middlings stream can be withdrawn from separation zone 21 and transferred via line 7 to middlings aeration zone 17. Air can be added to zone 17 via line 16. The aerated middlings stream from zone 17 can thereafter be mixed with the tar sand-water mixture in sump 20 or in conditioner 18 as previously indicated.

Normal recovery of bitumen from tar sands in the primary extraction zone of the above-defined hot water process lies in the range of 80 to 90 weight percent based on the quantity of bitumen in the tar sands. By the improvement of the present invention, an increase in recovery of bitumen from the primary extraction step in the order to 0.5 to 1.0 percent and above can be realized.

One mode of the present invention provides an improved process for the recovery of bitumen from tar sands comprising the steps:

a. forming a mixture of tar sands and water including that of the hereinafter specified recycle stream of aerated bitumen-rich middlings material;
b. settling the mixture in a separation zone to form an upper bitumen froth layer, a middlings layer containing water, silt, clay, and bitumen, and a sand tailings layer;
c. separately removing the bitumen froth layer and the sand tailings layer;
d. passing a stream of a bitumen-rich middlings layer from the separation zone into an air scavenger zone and therein aerating said stream to provide additional bitument froth;
e. recovering the froth from the scavenger zone;
f. passing a second bitumen-rich middlings stream to an aeration zone and mixing air into the middlings stream in said aeration zone and
g. admixing the aerated bitumen-rich middlings from the aeration zone with the mixture of step (a).

In essence, the present invention comprises that in a hot water extraction process for the recovery of bitumen from tar sands including the steps of:

a. forming a mixture of tar sands and water;
b. settling the mixture in a separation zone to form an upper bitumen froth layer, a sand tailings layer, and a middlings layer containing water, silt, clay, and bitumen;
c. separately recovering the bitumen froth layer and the sand tailings layer;
d. passing a stream of middlings to an air scavenger zone and therein aerating said middlings to provide additional bitumen froth and
e. recovering the additional bitumen froth, the improvement which comprises transferring a second bitumen-rich middlings stream from the separation zone to an aeration zone, ammixing the middlings stream with air in the aeration zone, and thereafter combining the aerated bitumen-rich middlings stream with the mixture of step (a).

In general, the present invention provides that in a hot water extraction process for the recovery of bitumen from tar sands including the steps of:

a. forming a mixture of tar sands and water;
b. settling the mixture in a separation zone to form an upper bitumen froth layer, a sand tailings layer, and a middlings layer containing water, silt, clay, and bitumen, and c. separately recovering the bitumen froth layer and the sand tailings layer, an improvement in bitumen recovery can be achieved by aerating the mixture of tar sands and water of step (a) prior to settling said mixture in step (b).

The invention claimed is:

1. An improved process for the recovery of bitumen from tar sands comprising:

a. forming a mixture of tar sands and water at a temperature in the range of 130° to 210°F. including that of the hereinafter specified recycle stream of aerated bitumen-rich middlings material; said mixture containing 0.2 to 3.0 pounds of water per pound of tar sands;

b. settling the mixture in a separation zone to form an upper bitumen froth layer, a middlings layer containing water, silt, clay, and bitumen, and a sand tailings layer;

c. separately removing the bitumen froth layer and the sand tailings layer;

d. passing a stream of middlings layer into an air scavenger zone and therein aerating said stream to provide additional bitumen froth;

e. recovering the froth from the scavenger zone;

f. passing a second bitumen-rich middlings stream to an aeration zone and mixing air into the middlings stream in said aeration zone and g. admixing the aerated bitumen-rich middlings from said aeration zone with the mixture of step (a).

* * * * *